US009615608B2

(12) United States Patent
Adeniji

(10) Patent No.: US 9,615,608 B2
(45) Date of Patent: Apr. 11, 2017

(54) POCKET SQUARE

(71) Applicant: Martin Adebayo Adeniji, Jamaica, NY (US)

(72) Inventor: Martin Adebayo Adeniji, Jamaica, NY (US)

( * ) Notice: Subject to any disclaimer, the term of this patent is extended or adjusted under 35 U.S.C. 154(b) by 113 days.

(21) Appl. No.: 14/559,722

(22) Filed: Dec. 3, 2014

(65) Prior Publication Data

US 2016/0157526 A1 Jun. 9, 2016

(51) Int. Cl.
*A41B 15/00* (2006.01)
*A41B 15/02* (2006.01)

(52) U.S. Cl.
CPC ..... *A41B 15/02* (2013.01)

(58) Field of Classification Search
CPC ..... A41B 15/00; A41B 15/02
USPC ..... 2/279
See application file for complete search history.

(56) References Cited

U.S. PATENT DOCUMENTS 1,361,384 A * 12/1920 Isaacs ..... A41B 15/02 2/247
1,515,447 A * 11/1924 Thomas ..... A45F 5/04 2/247
2,100,368 A * 11/1937 Weyman ..... G09F 19/10 2/279
2,592,033 A * 4/1952 Hicks ..... A41B 15/02 2/279
2,597,146 A * 5/1952 Ginal, Jr. ..... A41B 15/02 2/279
2,722,013 A * 11/1955 Fisher ..... A41B 15/02 2/279
2,738,515 A * 3/1956 Owen ..... A41B 15/02 2/279
2,815,509 A * 12/1957 Williamson ..... A41B 15/02 2/279
2,849,722 A * 9/1958 Cohen ..... A41B 15/02 2/279
3,174,157 A * 3/1965 Thomson, Jr. ..... A41B 15/02 2/279
3,280,488 A * 10/1966 Rubin ..... G09F 3/00 2/249
3,512,182 A * 5/1970 Bezanilla ..... A41B 15/02 2/249
5,253,370 A * 10/1993 Mead ..... A41B 15/02 2/247
D669,657 S * 10/2012 Lee ..... D2/500
D676,218 S * 2/2013 Lee ..... D2/500
D689,667 S * 9/2013 Lee ..... D2/500
D692,636 S * 11/2013 Lee ..... D2/500
D693,088 S * 11/2013 Lee ..... D2/500
D707,016 S * 6/2014 Lee ..... D2/500
D712,624 S * 9/2014 Lee ..... D2/500
9,051,681 B1 * 6/2015 Costa ..... D06F 89/02
2016/0073715 A1 * 3/2016 Fayed ..... A41D 27/201 2/253

* cited by examiner

*Primary Examiner* — Sally Haden
(74) *Attorney, Agent, or Firm* — Leason Ellis LLP

(57) ABSTRACT

A pocket square includes a main body and a first decorative panel that has a first appearance and is movable between an extended position in which at least a substantial portion of the first decorative panel is displayed by protruding above the main body and a retracted position in which at least a substantial portion of the first decorative panel is concealed within the main body.

4 Claims, 6 Drawing Sheets

POCKET SQUARE

TECHNICAL FIELD

The present invention is directed to fashion accessories and more specifically, is directed to an improved pocket square that provides multiple, different appearances.

BACKGROUND

Handkerchiefs have long been displayed in the top pocket of a men's jacket and when used in this manner, the handkerchief is referred to as a pocket handkerchief or pocket square. The handkerchief not only can serve a practical purpose but it also serves as a visible fashion item. Over time, a wide variety of different ways to fold the pocket square have been developed, ranging from the austere to the flamboyant.

While there are many different pocket squares on the market, there is a need for a pocket square that provides multiple wear options to allow wear with many different clothing fabrics, color schemes, etc.

SUMMARY

In one embodiment, a pocket square of the present invention includes a main body and a first decorative panel that has a first appearance and is movable between an extended position in which at least a substantial portion of the first decorative panel is displayed by protruding above the main body and a retracted position in which at least a substantial portion of the first decorative panel is concealed within the main body.

In another embodiment, the pocket square includes a main body (housing) that has a first layer having at least a first edge and a second edge and a second layer disposed proximate the first layer. The second layer has a first edge and a second edge. The first edges of the first and second layers are positioned proximate one another and similarly, the second edges of the first and second layers are positioned proximate one another.

The pocket square further includes a first decorative panel that is attached to the first and second layers in such a manner that the first decorative panel can be inverted to position the first decorative panel between an extended position in which at least a substantial portion of the first decorative panel extends above the first edges of the first and second layers for display and a retracted position in which at least a substantial portion of the first decorative panel is disposed between the first and second layers. The pocket square can further include a second decorative panel that is attached to the first and second layers in such a manner that the second decorative panel can be inverted to position the second decorative panel between an extended position in which at least a substantial portion of the second decorative panel extends above the second edges of the first and second layers for display and a retracted position in which at least a substantial portion of the second decorative panel is disposed between the first and second layers.

The decorative panels preferably have different visual appearance so as to provide the wearer with at least two different wearing options. Moreover, the pocket square can include third and fourth decorative panels which further yet increase the wearing options.

BRIEF DESCRIPTION OF THE DRAWING FIGURES

DETAILED DESCRIPTION OF CERTAIN EMBODIMENTS

Figure 1:
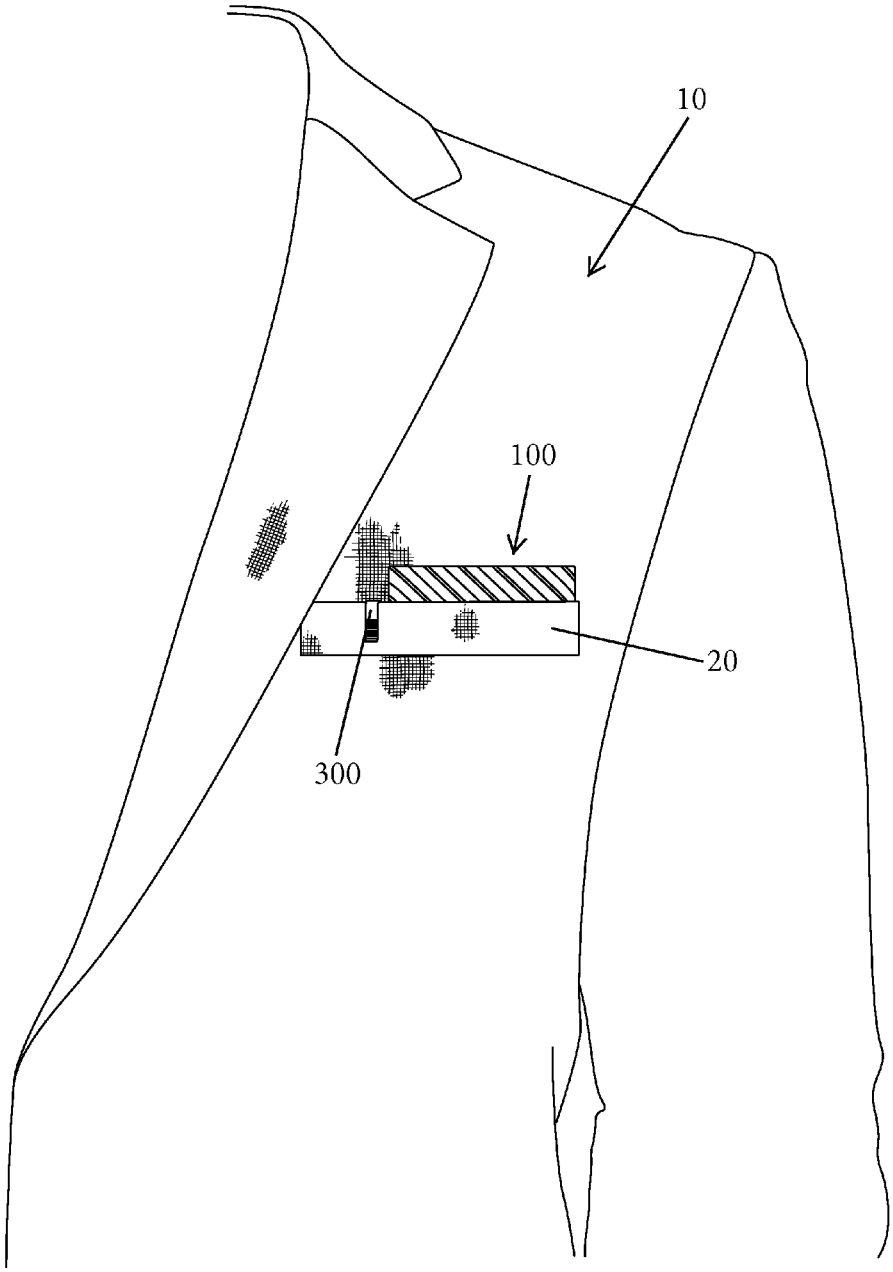
FIG. 1 is a front view of a pocket square according to one embodiment of the present invention inserted into a front pocket of a suit jacket.

FIGS. 1-4 illustrate a pocket square 100 according to a first embodiment and for insertion into a pocket 20 of an article of clothing 10, such as a suit jacket, blazer, vest, etc. The pocket square 100 is formed of first and second base layers 110, 120 that face one another in a spaced manner. In other words, the rear face of the first base layer 110 faces the front face of the second base layer 120. In the illustrated embodiment, the first and second base layers 110, 120 are not directly attached to one another as discussed herein.

It will be appreciated that the first and second base layers 110, 120 can be formed of any number of different materials including a wide range of fabrics (including synthetic fabrics and natural fabrics); velvet, suede, leather, plastics, microfiber, pleather, ultrasuede, carbon fibers, Alcantara®, etc. It will also be appreciated that the shape of the first and second base layers 110, 120 can vary. In the illustrated embodiment, each of the first and second base layers 110, 120 has a square shape; however, other shapes are possible including rectangular, etc. The first and second base layers 110, 120 will typically have at least substantially the same shape and be at least substantially the same size; however, it is possible and within the scope of the present invention that one of the layers 110, 120 be of a different size and/or shape. In one embodiment, each of the first and second base layers 110, 120 is constructed so as to have at least two distinct edges.

The pocket square 100 also includes a plurality (two or more) of decorative elements (panels, portions, or flares) 200 which define the main portion of the pocket square 100 that is visible outside of the pocket as by protruding above a top edge of the pocket. The decorative panel 200 is thus the main portion of the pocket square 100 that provides a decorative appearance and is fashion based. As will be appreciated herein, the incorporation of at least two decorative panels 200 in the pocket square 100 provides the wearer with two different options in terms of how the pocket square 100 is displayed in the pocket. The individual flares 200 are located along different edges of the pocket square 100 and thus, when one panel 200 is displayed, the other decorative panel(s) 200 can be concealed as discussed herein. This allows the wearer the ability to choose one decorative panel 200 for display and conceal the other decorative panel (s) 200 in such a way that the user can easily and quickly alter the pocket square appearance by changing which decorative panel 200 is displayed and which one(s) is concealed. This versatility allows a single pocket square 100 to provide the wearer with two or more different wearing options and thus increases the ability of the pocket square to be matched and be complimentary to different clothing.

Each decorative panel 200 can also be thought of as providing a structural connection between the first and second layers 110, 120 in that each decorative element 200 is connected between the first layer 110 and the second layer 120 and thus acts as bridge connecting these two structures together. In the embodiment shown in FIGS. 2-4, there are four decorative panels 200 and each decorative panel 200 is in the form of an elongated structure (e.g., rectangular) that has a first end 202, an opposite second end 204, a top edge 206 and an opposite bottom edge 208. Each panel 200 is securely attached to each of the first and second layers 110, 120 along one of its edges and more particularly, each panel 200 can be attached to each of the first and second layers 110, 120 along the bottom edge 208 thereof. The other edges, including the top edge 206 and the first and second ends 202, 204 remain detached from the first and second layers 110, 120. It will be appreciated from the views that edge 208 represents the bottom edge and the edge 206 represents the top edge when the first decorative panel 200 is in its extended position and conversely, edge 208 represents the top edge and the edge 206 represents the bottom edge when the first decorative panel 200 is in its retracted position. The use of the terms "bottom" and "top" is therefore not limiting but is merely for convenience.

Each panel 200 is folded so as to assume a U-shape in that a first portion of the bottom edge 208 is positioned adjacent a length of a first edge 111 of the first layer 110 and a second portion of the bottom edge 208 is positioned adjacent a length of a first edge 121 of the second layer 120.

Figure 2:
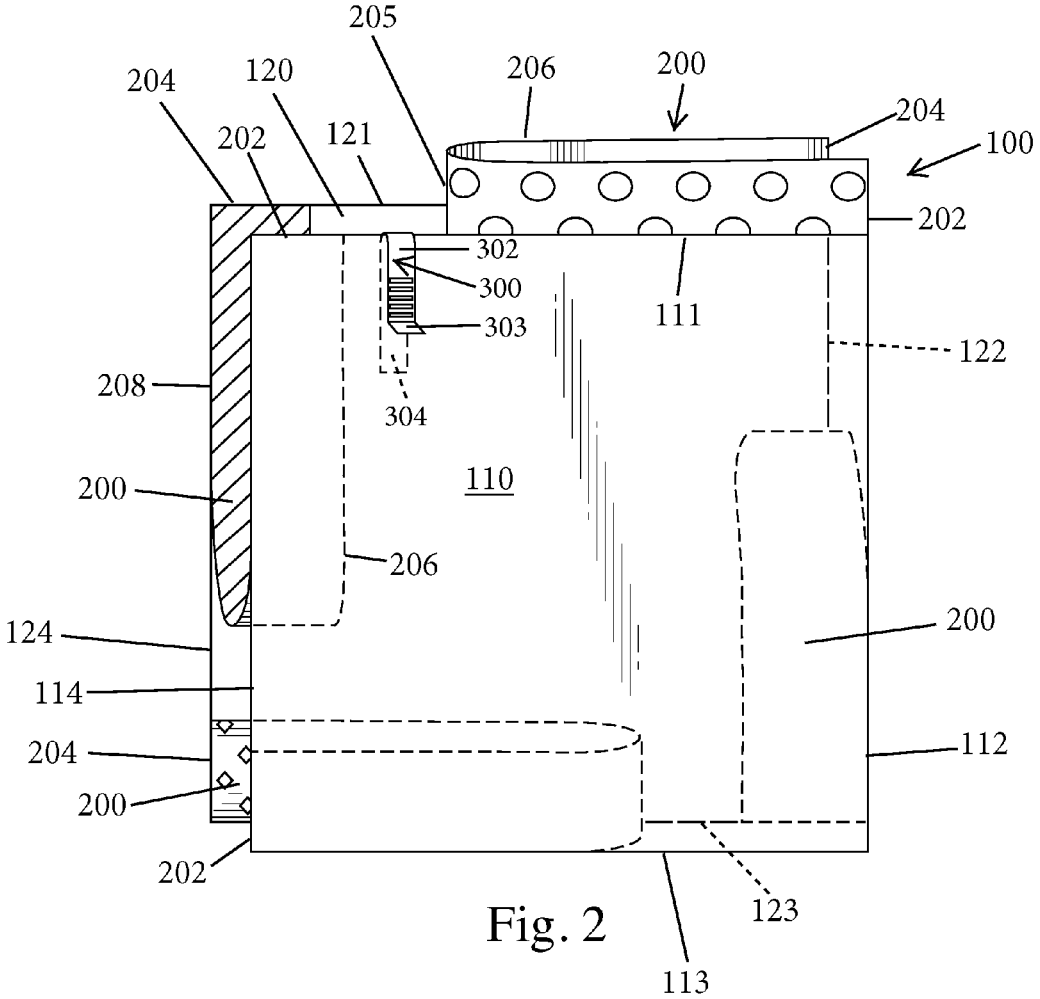
FIG. 2 is a front perspective view of a pocket square according to a first embodiment showing a first flare being in an extended, displayed position and the other flares being in retracted, stored positions.

Select portions of the bottom edge 208 is then securely attached to the first edges 111, 121 using traditional techniques, including but not limited to stitching, use of adhesives, use of mechanical fasteners, etc. As seen in the figures, the ends 202, 204 can be aligned with one corner of each of the first and second layers 110, 120. Also, an intermediate section (portion) of the bottom edge 208 is not attached to any structure and instead extends across the space between the first and second layers 110, 120. As best seen in FIG. 2, each panel 200 thus assume a U-shape due to the flare 200 being attached to both first edges 111, 121 of the layers 110, 120 (which defines the two legs of the U shape) and the portion 205 of the panel 200 that extends across the space between the two layers 110, 120 defines the curved base of the U.

The manner of coupling the panel 200 to the first and second layers 110, 120 allows for the panel 200 to be inverted as shown in FIG. 2. More specifically, since neither of the ends 202, 204 nor the top edge 206 is physically attached to the layers 110, 120, the panel 200 can be inverted by folding it on top of itself. This allows each panel 200 to be moved between and placed into one of two positions, namely, an extended position (wearing position) in which the panel 200 protrudes above the respective edges of the layers 110, 120 and a retracted position in which the panel 200 is at least substantially concealed and disposed between the two layers 110, 120.

When the first and second layers 110, 120 have a square or rectangular shape, one panel 200 can be disposed along each of the four edges of the first and second layers 110, 120 as shown in FIG. 2. FIG. 2 thus shows a second panel 200 formed along second edges 112, 122 of the first and second layers 110, 120; a third panel 200 formed along third edges 113, 123 of the first and second layers 110, 120; and a fourth panel 200 formed along fourth edges 114, 124 of the first and second layers 110, 120.

As shown in FIG. 2 and according to one embodiment, the lengths of the panels 200 are selected and the panels 200 are purposely positioned such that when the panels 200 are inverted they do not interfere with one another. In other words, all of the panels 200 can be inverted to their retracted positions without one panel 200 contacting (binding with) the other panels 200. This allows the panels 200 to be neatly kept in their retracted positions and reduces/eliminates any wrinkling and creasing thereof.

Each panel 200 is preferably constructed such that it has its own unique decorative indicia/appearance. The indicia shown in FIG. 2 is merely exemplary and is used to indicate that the panels 200 have different visual appearances.

Figure 4:
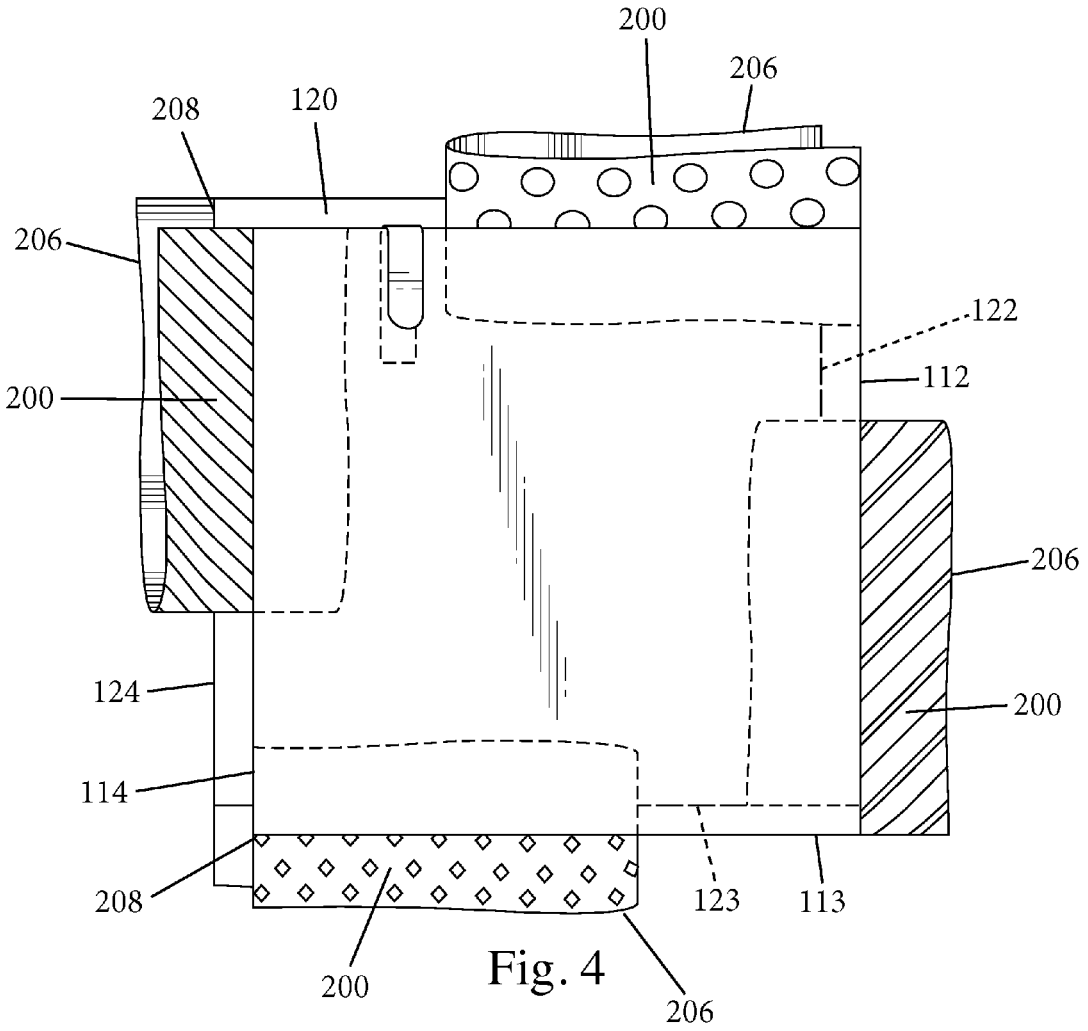
FIG. 4 is a front perspective view of the pocket square of FIG. 2 with all of the flares in the extended, displayed positions.

FIG. 4 shows all four of the panels 200 in the extended, displayed positions for illustration purposes.

It will also be understood that the panels 200 can be formed of different materials. For example, the panels 200 can be formed of different fabrics, such as cotton, silk, linen, wool/cashmere, synthetics, and blends thereof, etc., so long as the panel 200 can undergo an inversion and move between the extended and retracted positions.

Figure 3:
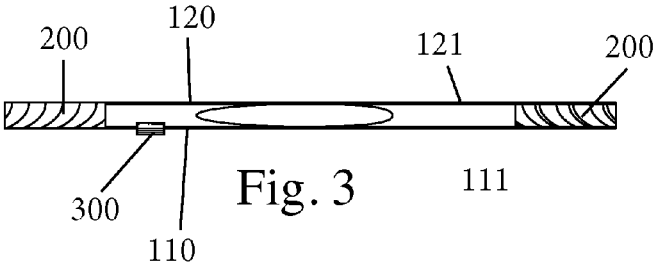
FIG. 3 is a top plan view of the pocket square of FIG. 2.

Since the panels 200 serve as the means for connecting the first and second layers 110, 120, the first and second layers 110, 120 can be slightly pulled apart from one another due to the intermediate portion of the panels 200 not being attached to the layers 110, 120. Thus, the degree of separation between the first and second layers 110, 120 can be about equal to the length of the intermediate portion of each panel 200 that is not attached to either of the layers 110, 120. FIG. 3 is a top plan view showing the two layers 110, 120 in a generally compressed state that is indicative and representative of the positions of the layers 110, 120 during wear.

In addition, the pocket square 100 can include a clip 300 or the like to assist in securing the pocket square 100 to the front pocket material of the jacket. The clip 300 can be formed of any number of different materials including wood, metals and plastics. The clip 300 is movable along one of the first and second layers 110, 120. The clip 300 can be a U-shaped bent structure that naturally applies a biasing force. In other words, one leg 302 (e.g., the front leg) of the clip 300 can be separated from the other leg 304 (thereby storing energy) and the material of the jacket pocket is inserted between the two legs against one of the layers 110, 120. When the one leg is released, the natural biasing force causes it to return to its original state, thereby clamping and securing the pocket square to the jacket pocket. The front leg 302 can have a bent portion 303 at its end to assist the user (wearer) in lifting the front leg 302 away from the pocket (thereby assisting in separating the two legs 302, 304 apart).

The orientation and positioning of the first and second layers 110, 120 in the pocket can be varied in that in one position, the first layer 110 is positioned forward in the pocket (as shown in FIGS. 1-2) so as to position the displayed flare 200 in a "right justified" manner when viewing the pocket straight on. Conversely, the positioning of the pocket square 100 can be reversed in that the second layer 120 can be positioned forward in the pocket so as to now position the displayed panel 200 in a "left justified" manner. Each panel 200 can be displayed in either of these two orientations.

Figure 5:
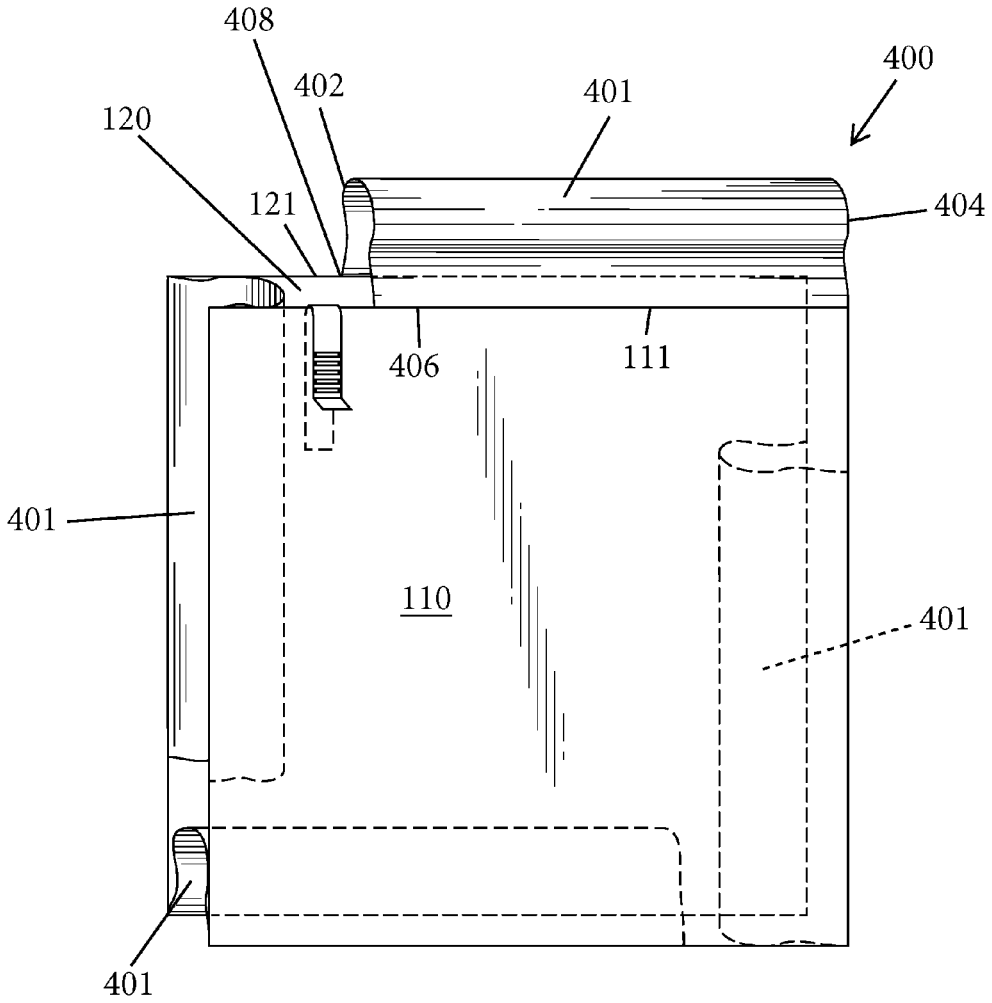
FIG. 5 is a front perspective view of a pocket square according to a second embodiment showing a first flare being in an extended, displayed position and the other flares being in retracted, stored positions.
Figure 6:
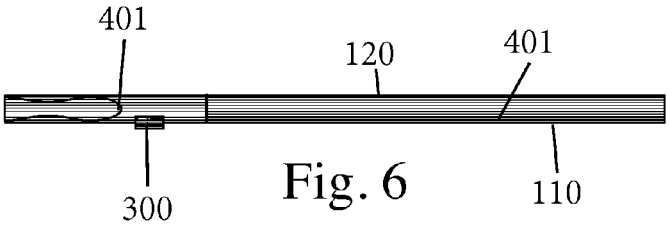
FIG. 6 is a top plan view of the pocket square of FIG. 5.
Figure 7:
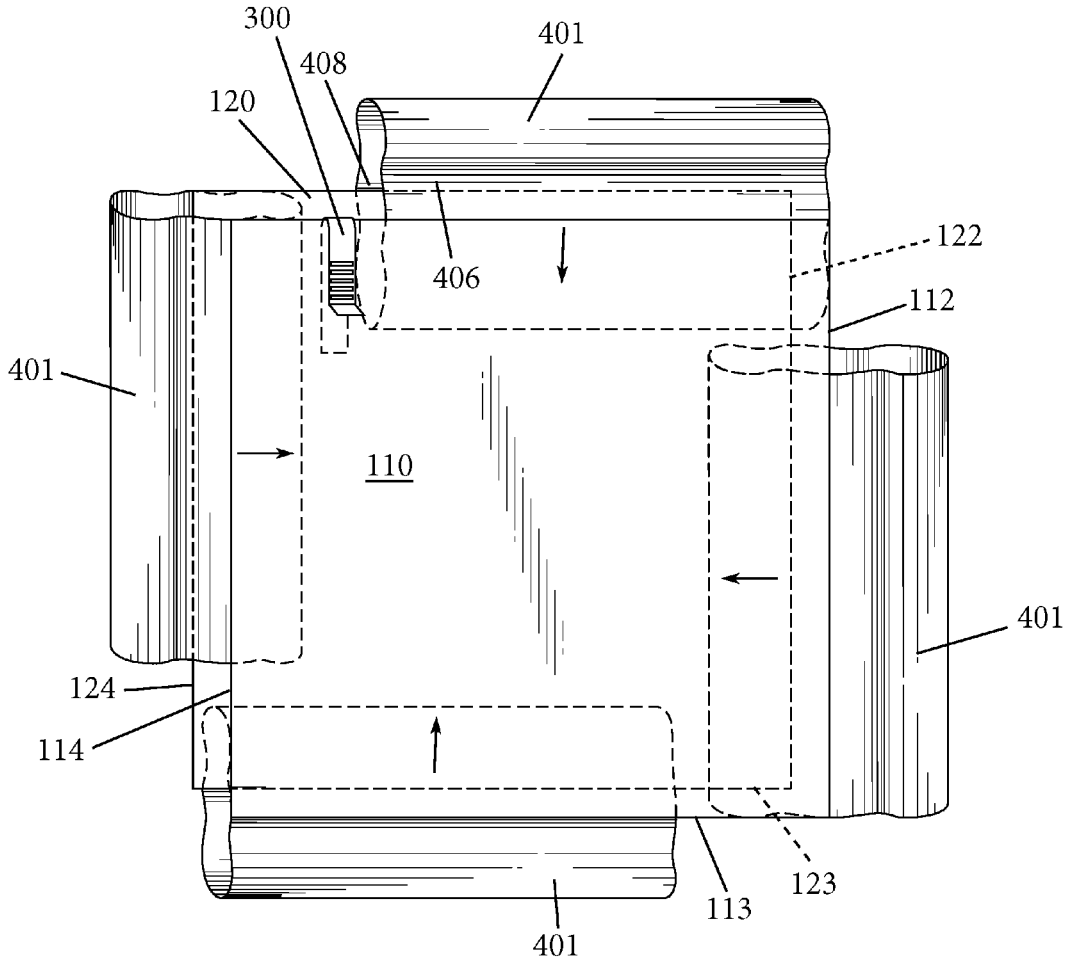
FIG. 7 is a front perspective view of the pocket square of FIG. 5 with all of the flares in the extended, displayed positions.

FIGS. 5-7 show a pocket square 400 that is similar to pocket square 100 and therefore, like elements are numbered alike. Pocket square 400 includes decorative panels (flares) 401 that are similar to flares 200 but have different constructions and are attached to the first and second layers 110, 120 in a different manner. The decorative panel 401 can also be thought to define a U shape; however, the decorative panels 401 are oriented in more of a tent-like fashion relative to the respective edge of the first and second layers 110, 120.

The decorative panel 401 has a first end 402, an opposite second end 404, a first edge 406 and an opposing second edge 408. The edges 406, 408 extend between the ends 402, 404. The decorative panel 401 is attached to the first and second layers 110, 120 in the following manner. The first edge 406 is attached to the first edge 111 of the first layer 110 and the second edge 408 is attached to the first edge 121 of the second layer 120. The ends 402, 404 are open and not attached to any structure.

While each panel 200 is open towards a respective corner of the pocket square, each decorative panel 401 is open towards the center of the pocket square. The panel 401 thus can be thought of as defining a tent-like structure. Panel 200 is open along its top, while panel 401 is closed along its top.

When the first and second layers 110, 120 have a square or rectangular shape, one panel 401 can be disposed along each of the four edges of the first and second layers 110, 120 as shown in FIG. 7. FIG. 7 thus shows a second panel 401 formed along second edges 112, 122 of the first and second layers 110, 120; a third panel 401 formed along third edges 113, 123 of the first and second layers 110, 120; and a fourth panel 401 formed along fourth edges 114, 124 of the first and second layers 110, 120.

To invert the panel 401, the wearer simply pushes (applies a force) against the panel 401 in a direction toward the center of the pocket square 400 (see arrows in FIG. 7). The results in a collapsing of the panel 401 and the panel 401 can be inserted between the first and second layers 110, 120. To extend the panel 401, the wearer simply inserts a finger between the layers 110, 120 and pushes the panel 401 upward, thereby causing the panel 401 to extend upward and protrude above the respective edges of the first and second layers 110, 120.

The pocket square 400 like the pocket square 100 is intended to be used by displaying one of the panels 401, while the other panels 401 are placed in their retracted positions (not displayed positions).

As in the previous embodiment, the panels 401 are intended to have different decorative appearances (different indicia), thereby providing the wearer with multiple wearing options in a single pocket square design.

The pocket square 400 like the pocket square 100 can include clip 300.

It will be appreciated that the size and specific shapes of the pocket squares 100, 400 and the components thereof can be varied and the illustrated embodiment is only exemplary and not limiting of the present invention.

In one embodiment, one or more of the layers 110, 120 can be constructed in the form of a bill-fold in that the layer 110, 120 can includes slits for receiving bills. In addition, one or more of the layers 110, 120 can include air vents, such as perforations, etc.

In addition, the layers 110, 120 can be formed of the same material or can be formed of different materials and further, the layers 110, 120 can have the same appearance (e.g., the same color) or can have different appearances.

In yet another embodiment, the decorative panels 200, 401 can be detachably coupled to the first and second layers 110, 120. For example, each of the decorative panels can include one or more fasteners and the first and second layers 110, 120 include complementary fasteners to provide a detachable coupling between the decorative panel 200, 401 and the first and second layers 110, 120. For example, the fasteners can be in the form of hook and loop material or other fasteners, such as snaps, zippers, etc. Alternatively, the decorative panel can be permanently attached to the first and second layers 110, 120.

It will also be appreciated that the pocket square 100 can be constructed such that it includes at least one decorative panel 200 and at least one decorative panel 401 and thereby has decorative panels of different constructions. This provides yet another difference in terms of the visual appearance of the pocket square.

While in a preferred embodiment, the first and second layers 110, 120 are not directly attached to one another, it will be appreciated that the layers 110, 120 can be attached to one another at a location that does not interfere with the movements of the decorative panels.

Figure 8:
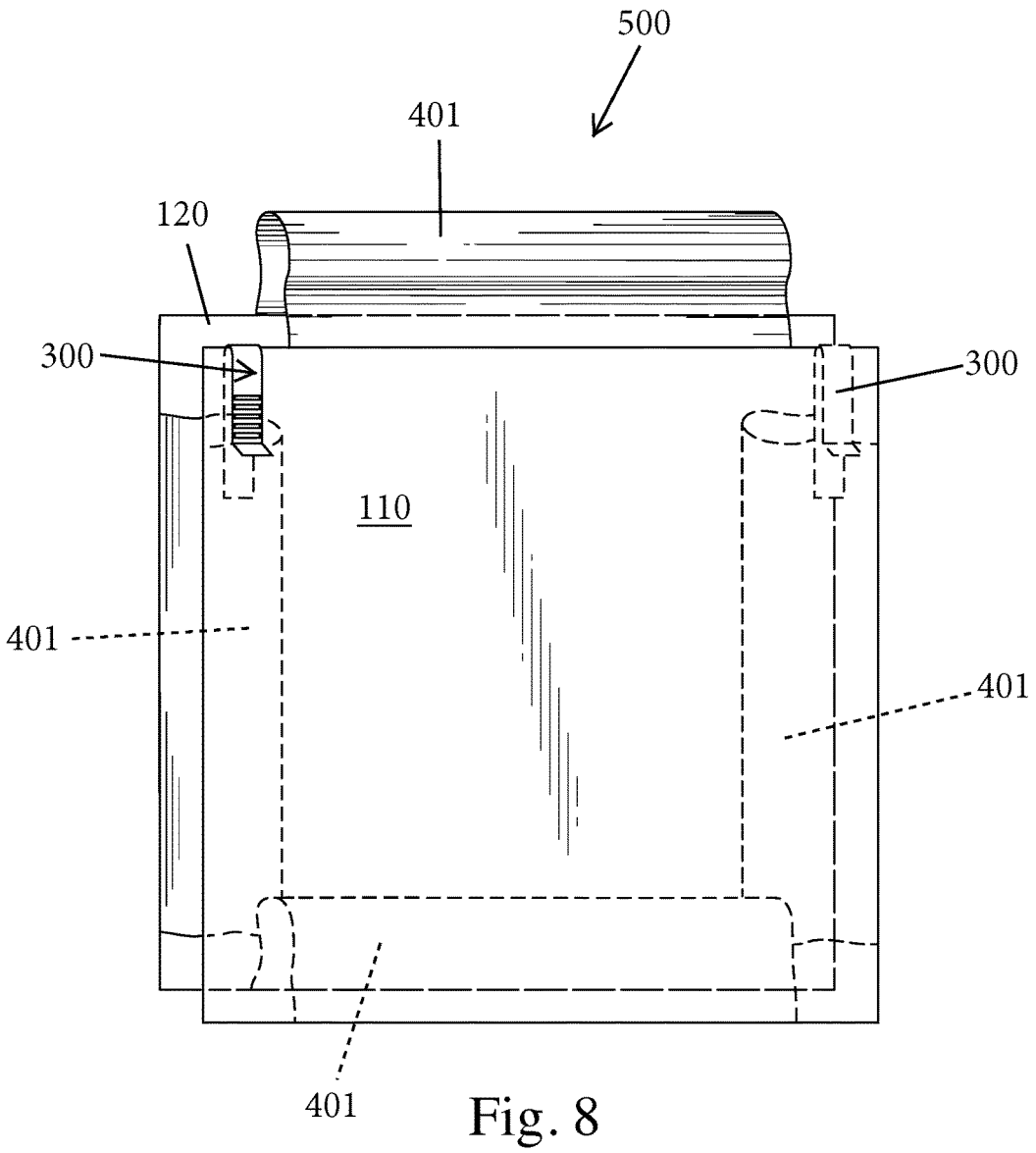
FIG. 8 is a front perspective view of a pocket square according to a third embodiment showing a first flare being in an extended, displayed position and the other flares being in retracted, stored positions.

FIG. 8 shows another embodiment similar to the one disclosed in FIGS. 5-7 and therefore like elements are numbered alike. FIG. 8 shows a pocket square 500 that is similar to pocket square 400 with the exception that each of the decorative panels 401 is "center-justified" relative to the respective edge to which the panel is attached. In addition, clip 300 is shown in two alternate wearing locations in that the clip 300 can be worn on one side of the decorative panel or can be worn on the other side of the decorative panel. The user (wearer) can thus choose between the two positions for placement of the clip 300. As mentioned herein, the clip 300 serves to couple (anchor) the pocket square to the pocket of the article of clothing.

While FIG. 8 shows the decorative panel 401 being center-justified, it will be appreciated that the decorative panel 200 of the first embodiment can be constructed and positioned in a similar center-justified manner.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A pocket square comprising:

a main body comprising:

a first layer having a first peripheral edge, a second peripheral edge, a third peripheral edge, and a fourth peripheral edge;

a second layer separate and spaced from the first layer and being disposed proximate the first layer, the second layer having a first peripheral edge, a second peripheral edge, a third peripheral edge, and a fourth peripheral edge;

the second layer being a substantially same shape and a substantially same size as the first layer, the first peripheral edge of the first layer being positioned proximate the first peripheral edge of the second layer, the second peripheral edge of the first layer being positioned proximate the second peripheral edge of the second layer, the third peripheral edge of the first layer being positioned proximate the third peripheral edge of the second layer, and the fourth peripheral edge of the first layer being positioned proximate the fourth peripheral edge of the second layer;

at least a first decorative panel and a second decorative panel, each of the first and second decorative panels having a first portion attached to the first layer, a second portion attached to the second layer, and a u-shaped intermediate section extending between the first and second portions, wherein each u-shaped intermediate section is unattached to the first and second layers and extends across a space between the first and second layers, each of the first and second decorative panels having an extended position and a retracted position;

wherein the first decorative panel first portion is directly attached to the first peripheral edge of the first layer and the first decorative panel second portion is directly attached to the first peripheral edge of the second layer, in the extended position of the first decorative panel, the intermediate section of the first decorative panel extends above the first peripheral edges of the first and second layers for display, in the retracted position of the first decorative panel, the intermediate section of the first decorative panel is inverted and the first decorative panel is concealed between the first and second layers and the intermediate section of the first decorative panel extends below the first peripheral edges of the first and second layers;

wherein the second decorative panel first portion is directly attached to the second peripheral edge of the first layer and the second decorative panel second portion is directly attached to the second peripheral edge of the second layer, in the extended position of the second decorative panel, the intermediate section of the second decorative panel extends above the second peripheral edges of the first and second layers for display, in the retracted position of the second decorative panel, the intermediate section of the second decorative panel is inverted and the second decorative panel is concealed between the first and second layers and the intermediate section of the second decorative panel extends below the second peripheral edges of the first and second layers;

wherein each of the first and second decorative panels are free of direct attachment and contact between one another;

wherein the first layer is not directly attached to the second layer;

wherein the first layer is indirectly attached to the second layer by each of the first and second decorative panels.

2. The pocket square of claim 1, wherein each of the first and second layers is formed of a material selected from the group consisting of: natural fabrics, synthetic fibers, leather, velvet, suede, carbon fibers, and plastics.

3. The pocket square of claim 1, wherein the first layer and the second layer are square.

4. The pocket square of claim 1, further including a third and fourth decorative panel, each of the third and fourth decorative panels having a first portion attached to the first layer, a second portion attached to the second layer, and a u-shaped intermediate section extending between the first and second portions, wherein each u-shaped intermediate section is unattached to the first and second layers and extends across a space between the first and second layers, each of the third and fourth decorative panels having an extended position and a retracted position;

wherein the third decorative panel first portion is directly attached to the third peripheral edge of the first layer and the third decorative panel second portion is directly attached to the third peripheral edge of the second layer, in the extended position of the third decorative panel, the intermediate section of the third decorative panel extends above the third peripheral edges of the first and second layers for display, in the retracted position of the third decorative panel, the intermediate section of the third decorative panel is inverted and the third decorative panel is concealed between the first and second layers and the intermediate section of the third decorative panel extends below the third peripheral edges of the first and second layers;

wherein the fourth decorative panel first portion is directly attached to the fourth peripheral edge of the first layer and the fourth decorative panel second portion is directly attached to the fourth peripheral edge of the second layer, in the extended position of the fourth decorative panel, the intermediate section of the fourth decorative panel extends above the fourth peripheral edges of the first and second layers for display, in the retracted position of the fourth decorative panel, the intermediate section of the fourth decorative panel is inverted and the fourth decorative panel is concealed between the first and second layers and the intermediate section of the fourth decorative panel extends below the fourth peripheral edges of the first and second layers.

* * * * *